United States Patent [19]

Corso

[11] Patent Number: 5,018,663

[45] Date of Patent: May 28, 1991

[54] HAND CARRYABLE RESH PRODUCE CONTAINER

[75] Inventor: Thomas I. Corso, Pittsburgh, Pa.

[73] Assignee: Corso Bros., Inc.

[21] Appl. No.: 452,992

[22] Filed: Dec. 18, 1989

[51] Int. Cl.[5] ..... B65D 5/46; B65D 5/48

[52] U.S. Cl. ..... 229/117.13; 229/120; 229/148; 229/162

[58] Field of Search ..... 229/117.12, 117.13, 229/142, 148, 149, 162, 120, DIG. 14

[56] References Cited

U.S. PATENT DOCUMENTS

| | | | |
|---|---|---|---|
| 1,946,315 | 2/1934 | Ferguson . | |
| 2,081,419 | 5/1937 | Benschoter . | |
| 2,170,714 | 8/1939 | Ferguson | 229/162 |
| 2,192,307 | 3/1940 | Green | 229/162 |
| 2,398,797 | 4/1946 | Meyer et al. . | |
| 2,472,183 | 6/1949 | Williamson . | |
| 3,357,630 | 12/1967 | Michelitsch . | |
| 3,650,383 | 3/1972 | Nigro | 229/162 |
| 3,695,505 | 10/1972 | Wolf . | |
| 3,974,911 | 8/1976 | Graser | 229/117.12 |
| 4,101,048 | 7/1978 | Rieben . | |
| 4,171,763 | 10/1979 | Card . | |
| 4,266,716 | 5/1981 | Austin . | |
| 4,381,071 | 4/1983 | Vergiels | 229/148 |
| 4,588,084 | 5/1986 | Holley, Jr. | 229/117.12 |
| 4,709,852 | 12/1987 | Stoll . | |

*Primary Examiner*—Gary E. Elkins

[57] ABSTRACT

A preformed blank of corrugated sheet material for assembly of a container for fresh produce, and a container assembled from such blank and comprising a bottom, side walls reinforced at least at the corners of the container for enhancing its vertical compressive strength, a pair of top walls having container closure tabs formed therein and cooperating with registrable slots therein for frictional closure of the container. Each top panel has a pair of parallel elongated hand carry slots registrable with each other in a closed container position, the adjacent parallel edges of at least one pair of slots being connected to the sheet material and the remainder of the slot peripheries being perforated to form a pair of push-in flaps. At least one side wall has opening patterns spaced apart in the vertical and horizontal directions for visual inspection of the container contents and facilitating air circulation within the closed container.

29 Claims, 4 Drawing Sheets

HAND CARRYABLE RESH PRODUCE CONTAINER

BACKGROUND OF THE INVENTION

The packaging, transportation, retail display and storage of fresh vegetables and fruits require special environmental conditions, such as temperature, humidity, light, etc., for maintaining the freshness of such products in terms of food value and appearance until consumed. Proper packaging of such foods plays an important role in achieving such desirable results.

Many types of packaging are used for such purposes. A common type of package is the corrugated paperboard (fiberboard) container which is readily available at low cost and is light weight and, being biodegradable, is environmentally acceptable for general use. However, although such containers commonly are used for the packaging and distribution of wholesale quantities of fresh produce, they are less often used for the packaging of smaller quantities of many kinds of produce, for example, potatoes, onions, citrus and other fruits, which usually are presented either loose or in paper or plastic net bags for retail consumer purchase and use. In those instances when corrugated cartons are so used, it is common practice to utilize one of the many standardized container forms which are readily available from manufacturers, for example, as shown and described in the Fibre Box Handbook published by the Fibre Box Association and meeting standard shipping specifications such as those of the National Railroad Freight Committee and the American Trucking Association. Such boxes include various container designs adapted for bulk transportation of goods of various types, sizes and weights. Such standard container designs and related paperboard and container specifications are directed primarily to the various parameters defining the container's carrying capacity and strength e.g. in terms of resistance to bursting or crushing under various types of applied forces to which containers are subjected during transportation and storage. Comparatively much less attention has been paid to providing containers adapted to the special environmental requirements of particular types of fresh produce, especially in retail quantities suitable for carry-out by the consumer.

When produce is retailed in loose, bulk form, the consumer has the responsibility and chore of picking through the displayed produce, selecting that of acceptable quality, and bagging the selected produce for purchase. Such handling of easily bruised fruits and vegetables in bulk form also results in considerable loss and quality reduction. When fresh produce is packaged in other forms of containers, such as paper or plastic bags, the quality range, for example, in term of product size, form, appearance, etc. is determined by the packager and may not suit the needs or desires of the purchaser. In either case, the attention and care needed to maintain special quality characteristics often is lacking or minimal. For example, potatoes are subject to greening on excessive exposure to light. Either bulk presentation or packaging in light-admitting containers can result in quality deterioration of such products. During storage, apples and some other fruits give off ethylene gas which must be removed to maintain quality. Humidity control, where required, is difficult or impossible to achieve where produce is handled in bulk quantity lots or in substantially fully open or in fully closed containers. Size and shape of some produce items, such as potatoes, also is of importance, not only for appearance, but for the manner of cooking to be used. For example, in cooking in the microwave oven, cooking time is a function of size of the food item. If such items of greatly different sizes are microwaved, some will be overdone and some underdone.

SUMMARY OF THE INVENTION

Therefore, it is an object of this invention to provide an improved hand-carryable corrugated paperboard container for packaging, transporting and storing fresh produce, particularly such items of preselected size, and for aiding in freshness maintenance by limiting access of light to the container interior and providing a limited degree of air circulation thereby promoting maintenance of desirable temperature and humidity conditions within the container, while providing visual consumer access to the interior of the container and its contents.

Figure 1:
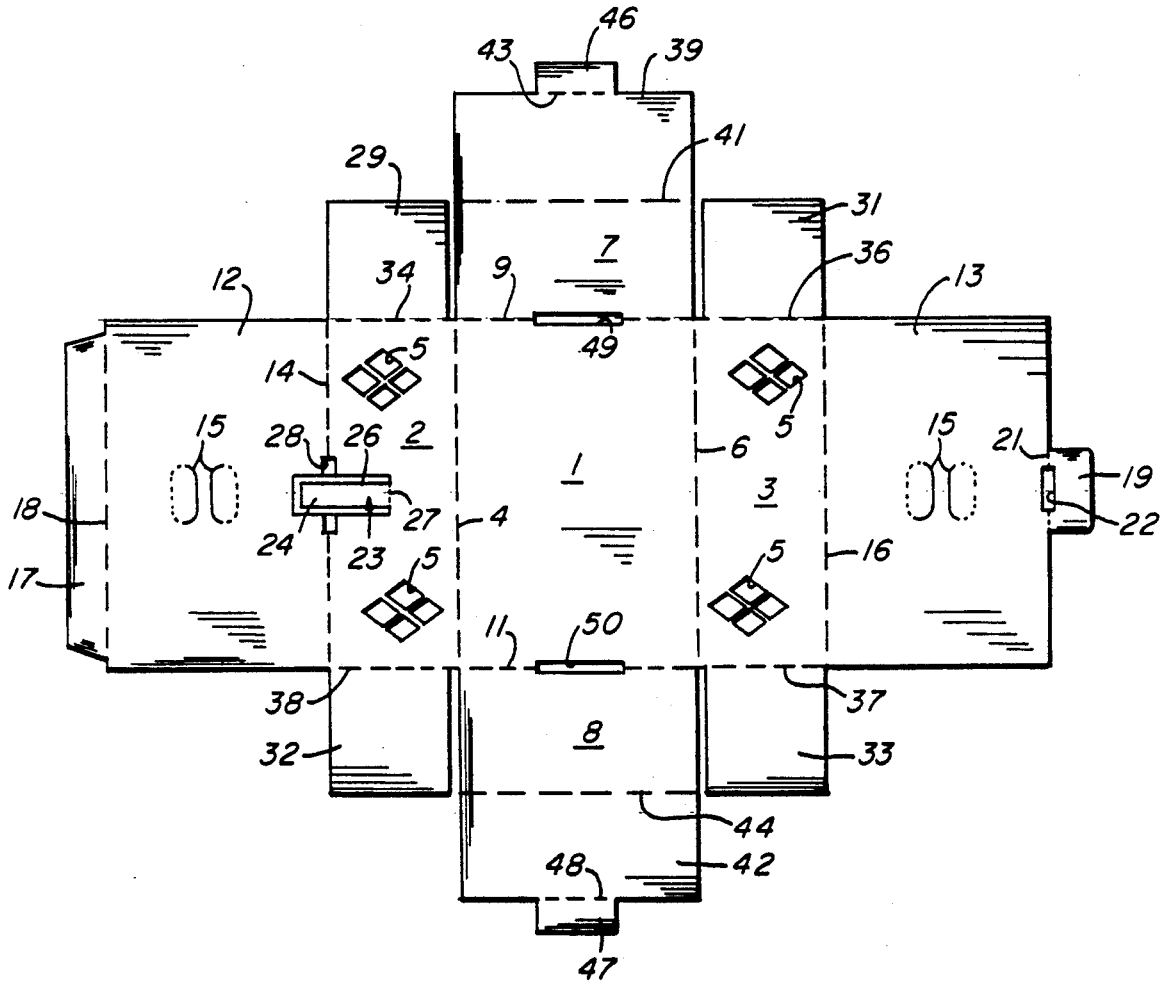
FIG. 1 is a plan view of a container blank, formed of a flat sheet of corrugated paperboard, from which a container in accordance with one embodiment of the invention can be assembled, and wherein the inside surface of the assembled container is formed by the blank surface so shown.

Referring more particularly to FIG. 1, the blank there depicted comprises a number of panels defined by the blank edges and a number of foldable score lines in the sheet material of which the blank is formed and comprising a bottom panel, a plurality of side panels forming the side walls of the container, and at least two top panels forming the top of the container. The bottom panel 1 is hingedly connected, along score line 4, to a first side panel 2, and by means of score line 6, to a second side panel 3. Each of the side panels 2 and 3 is provided with opening patterns 5, the functions of which will be later described. Bottom panel 1 is connected to a first (primary) end panel 7 by means of score line 9 and to a second (primary) end panel 8 by means of score line 11. A first top panel 12 is connected by means of score line 14 to the first side panel 2, and a second top panel 13 is connected by means of score line 16 to the second side panel 3. Hand carry slots 15 are formed in the sheet material of top panels 12 and 13 in a central portion thereof and at about the inertial center of the container. These slots are of an elongated, generally rectangular shape of length and width dimensions and spaced apart a distance such that a carrier's hand can easily be inserted in the slots and grasp the handle formed by the sheet material between each pair of slots. The spacing of the slot pairs is such that the sheet material therebetween is of sufficient strength to resist rupture when the container is lifted and carried.

The first top panel 12 is connected, by means of score line 18 defining an outer edge of this panel, to a closure flap 17. Top panel 13 has a primary closure tab 19 extending outwardly of the outer edge thereof. Tab 19 is formed of the same sheet material as panel 13 and is connected to it along score line 21 which is coincident with the outer edge of panel 13. A secondary closure tab slot 22 is formed in tab 19. A primary closure tab slot 28 is formed in the material along the score line connection between panels 2 and 12 and is adapted to receive the primary closure tab 19 in a closed container position. A secondary closure tab, generally denoted by the numeral 23, is formed from the material of panels 2 and 12, and has an inner end portion 26 having its extremity connected to the material of panel 2 along a score line 27. An outer end portion 24 of tab 23 is adapted to be received within the secondary closure tab slot 22 in a closed position of the container.

Additional side wall panels consisting of secondary end panels 29, 31, 32 and 33 are respectively connected to the side panels 2 and 3 by means of score lines 34, 36, 37 and 38.

A first tertiary end wall panel 39 is connected along score line 41 to primary end panel 7, and a second tertiary end wall panel 42 is connected along score line 44 to primary end panel 8. First and second end wall securing tabs 46 and 47 extend outwardly, respectively, from the outer edges of panels 39 and 42 along score lines 43 and 48 and are adapted to be received, respectively, in first and second end wall securing tab slots 49 and 51 in bottom panel 1.

A container is assembled from the blank of FIG. 1 by folding side panels 2 and 3 and primary end panels 12 and 13 into an upright position at right angles to bottom panel 1. Secondary end panels 34, 36, 37 and 38 are folded at right angles to side panels 2 and 3 such that one surface of each of the secondary end panels overlies a corresponding portion of the interior surface of the corresponding primary end panels 7 and 8. As shown in FIG. 1, each of panels 34, 36, 37 and 38 may have the dimensions thereof which extend in the container width direction equal to one-half of the container width, whereby each opposed pair of the secondary end panels forms a full secondary end reinforcing wall. Alternatively, these secondary end panels may have a smaller dimension in such direction, it being necessary only that these panels have sufficient width to contribute a significant reinforcing effect to the corresponding vertical corners of the container. Tertiary end panels 39 and 42 then are folded inwardly and downwardly of the container interior in a position overlying the corresponding juxtaposed secondary panels 34, 36, 37 and 38 and the end securing tabs 46 and 47 are inserted respectively into tab securing slots 48 and 49 thereby forming triple-layer container end walls of enhanced resistance to crushing upon container stacking.

The assembled container is closed by folding the first top panel 12 inwardly and downwardly of the container interior such that the closure flap 17 is in frictional engagement with the inner surface of the second side wall panel 3. The second top panel 13 then is positioned to overlie the first top panel and the primary closure tab 19 is inserted into primary closure tab slot 28 and the outer portion 24 of the secondary closure tab is inserted into secondary closure tab slot 22, thereby frictionally detachably securing the container top in a closed position.

In such position, the two pairs of slots 15 in each of the top panels are in registry, providing means for hand carrying the container.

In the assembled container position, the opening patterns 5 in the container side walls, or either of them, provide means for visual inspection of the container contents. To avoid loss of contents, the individual openings have a maximum dimension less than the minimum dimension of the intended produce to be packaged in the container. Such openings are arranged in patterns wherein sufficient sheet material remains between the openings so as to avoid reduction of the strength of the assembled container below that necessary for application as herein described. Thus, I have found most useful for such purpose, openings of a parallelogram or generally "diamond" shape in similarly shaped patterns arranged horizontally, i.e. having a longer pattern dimension generally parallel to the top and bottom edges of the container side wall in which the patterns are located. Such shape of openings and patterns leaves, between the openings in each pattern, a generally "X-shaped" lattice area of sheet material providing maximum strength of the remaining side wall area and, thereby, minimum reduction of container compressive strength.

As illustrated in FIG. 1, these opening patterns are spaced apart both horizontally and vertically in the assembled container. Such positioning of these patterns of openings provides a flue-like effect facilitating a desirable natural convective flow of air into and out of the container thereby aiding maintenance of the freshness of contained fresh produce. Thus, as the air in the container warms, the warmed air exits the container through the higher-spaced openings and is replaced by cooler outside air which is drawn into the container through the lower spaced openings. Horizontal spacing of the opening patterns provides an air-travel path from end-to-end of the container. In case of produce as may give off gases during storage, such gases are removed from the container by this means, thus continually providing a fresh air environment conducive to maintenance of produce quality.

In cases where some degree of control of humidity within the container is desirable, the corrugated paperboard sheet material of which the container is constructed may contain a moisture-resistant material. For example, a mixture of cornstarch and caustic soda may be provided in the flutes of the core of a double-faced corrugated paperboard sheet. Such materials provide a container in which the facing members of the sheet are of improved resistance to moisture absorption and thereby contribute to a lower container moisture content which may be desirable in maintaining freshness quality of the contained produce. An additional advantage of such construction is improved crushing and bursting strength of containers made from such materials due to the action of the moisture-resistant material in reducing the content of water absorbed by the naturally hygroscopic paperboard material.

The material of construction of the blanks of this invention and the containers assembled therefrom is an important factor in the transportation, storage and use of the filled containers. For example, the produce industry normally uses a standard pallet of 40 inches by 48 inches bed dimensions and such pallets normally are designed to accommodate a maximum loaded weight of 2000 pounds. It also is standard practice in transporting fresh produce by automotive truck to provide a maximum truck loading of 40,000 pounds. The design of the containers of this invention takes into account:

(1) internal container dimensions which provide an interior volume accommodating produce of preselected size and specified number and weight;

(2) specification of corrugated sheet material which, while suitable for construction of containers having the required internal volume, also can be used for constructing containers which:

(a) have outside dimensions such that a specified, integral number of containers will provide a full layer on a standard pallet bed;

(b) accommodate a weight of contents such that a specified number of layers of containers on a pallet will provide a full 2000 pound pallet loading, and (c) have a compression strength sufficient to resist crushing and bursting when the containers are vertically stacked on the pallet in a sufficient number of layers to provide a 2000 pound pallet loading.

For example, I have found that a container for packaging ten to twenty No. 100 size potatoes (a convenient number for retail sale of this premium size potato measuring about 5×2.5×1.5 inches plus or minus about 0.5 inch—which is ideal for microwave cooking), representing a produce weight of 5 to 10 pounds, and meeting the above-listed container requirements, can be made from double-faced corrugated sheet material having outside and inside facing weights of, respectively, from 33–33 to 42–42 pounds per thousand square feet and a fluted (for example a C-flute) core corrugating medium of at least 26 pounds per thousand square feet weight, wherein such material has a bursting strength of from about 150 to about 200 pounds per square inch. Using such material, there can be provided a container having exterior dimensions of 12 inches length, 8 inches width, and 4.5 inches depth, and, taking into account the container wall thicknesses, an interior volume sufficient to contain five pounds of produce in the form of ten No. 100 size potatoes. Twenty such containers are accommodated in one layer on a standard 40×48 inch pallet and the containers can be stacked 20 containers high to provide a 2000 pound pallet loading without crushing of the containers. Similarly, a container of the same exterior length and width dimensions and an exterior depth of 9 inches will accommodate twenty (10 pounds) No. 100 size potatoes and the containers can be stacked 10 high to provide the required 2000 pound pallet loading.

It is known that over sixty percent of the stacking strength of a container is concentrated near the vertical corners of the container. I have taken this fact into account in the design of the containers of this invention which must have a stacking strength in pallet loading as above described. Thus, I also have found that, using a corrugated paperboard sheet material as described above, it is preferable, for best assurance against damage of the containers on such stacking, that at least one pair of the container side walls, that is, either the end walls or the front and back walls of the container, be composed, at least in part near the container corners, of at least two sheets of the paperboard material. As above-described in connection with the FIG. 1 embodiment of this invention, one pair of such panels may extend, and preferably does extend, for a total distance less than the full width of the container—as long as sufficient sheet material is provided in such panels to provide reinforcement of the container corners.

I have found, further, that with the above-described construction of the inventive containers, a double container top, for example as shown in FIG. 1, adds desirable compressive strength on stacking and is required to provide sufficient tensile strength to resist rupture of the container top during lifting and carrying.

Lighter weight and lesser strength corrugated sheet material does not provide the needed strength properties for the construction of the containers of this invention. On the other hand, substantially heavier and stronger corrugated sheet material, for example triple wall corrugated material having a larger number of facing and/or core members, are not only more costly but also would require either a reduction of the interior volume of the container in order to maintain the needed exterior dimensions or would necessitate an increase of the exterior dimensions in order to provide the needed interior volume.

Thus the container designs and associated materials of construction in accordance with this invention represent a balance of properties necessary for meeting the intended container applications at lowest feasible cost.

In further illustration of the critical nature of the features of this invention, it is to be noted that, due to the construction of the top closure means of the invention, exceptionally strong resistance to rupture of the closure upon lifting and carrying the container is provided. Application of the corresponding tensile force to the overlying second top panel, such as panel 13 of FIG. 1, and through that panel to the primary closure tab, such as tab 19 of FIG. 1, results in an opposite, downwardly-directed force being applied to the primary closure tab, such as tab 19 of FIG. 1, by the secondary closure tab, such as tab 23 of FIG. 1. Moreover, provision of a double top panel construction, such as first and second top panels 12 and 13 of FIG. 1, has the further result that at least a substantial fraction of such vertically-applied tensile force is transferred through the underlying, first top panel to the side panel to which it is connected, for example, from first top panel 12 of FIG. 1, through the sheet material along score line 14, to the first side panel 2 of FIG. 1. This is in addition to the transfer of tensile force from the second top panel to the side panel to which it is connected, such as from top panel 13 to side panel 3 in FIG. 4. These combined effects of the construction of the containers of the invention gives maximum assurance against unintended breaking of the container closure during handling.

Figure 2:
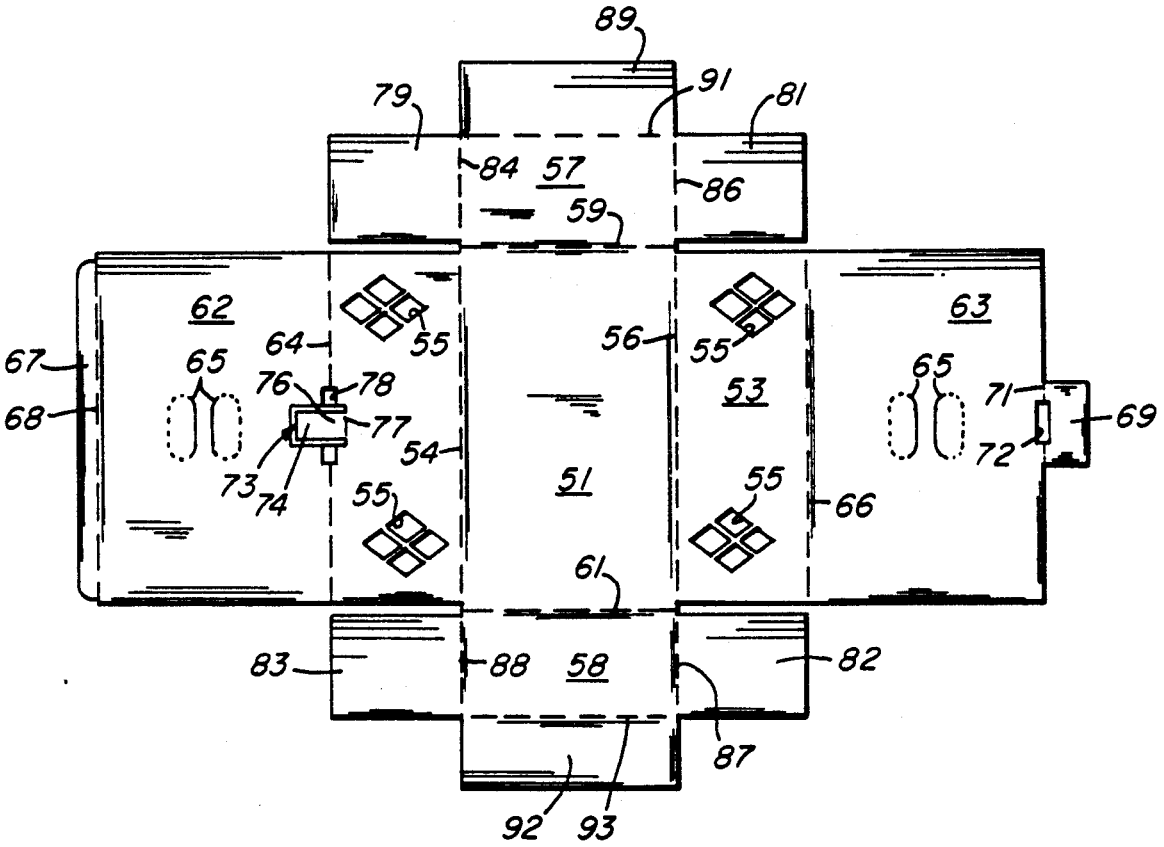
FIG. 2 is similar view of another form of a container blank for assembly of another container embodiment of the invention.

Turning next to FIG. 2, that figure depicts a container blank having a bottom panel 51 hingedly connected to first and second (primary) side panels 52 and 53 along score lines 54 and 56 respectively. Each of the primary side panels 52 and 53 is provided with opening patterns 55. Bottom panel 51 is connected to first and second end panels 57 and 58 along score lines 59 and 61 respectively. First and second (principal) top panels 62 and 63 are connected, respectively, along score lines 64 and 66, to (primary) side panels 52 and 53, and each principal top panel is provided with a pair of hand carry slots 65. As in the embodiment of FIG. 1, these slots are formed in the sheet material of top panels in the inertial center of the container. The first (principal) top panel 62 is connected to closure flap 67 by means of score line 68 defining an outer edge of panel 62.

The second (principal) top panel 63 has a primary closure tab 69 extending outwardly of the outer edge thereof. Tab 69 is formed of the same sheet material as panel 63 and is connected to it along score line 71 which is coincident with the outer edge of panel 63. A secondary closure tab slot 72 is formed in tab 69. A primary closure tab slot 78 is formed in the material along the score line connection between panels 52 and 62 and is adapted to receive the primary closure tab 69 in a closed container position. A secondary closure tab, generally denoted by the numeral 73, is formed from the material of panels 52 and 62, and has an inner end portion 76 having its extremity connected to the material of panel 52 along a score line 77. An outer end 74 of tab 73 is adapted to be received within the secondary closure tab slot 72 in a closed position of the container.

Secondary side wall panels 79, 81, 82 and 83 are respectively connected to the first and second end panels 57 and 58 by means of score lines 84, 86, 87 and 88 for reinforcing side panels 52 and 53 and the container corners.

For reinforcing the container top, a first (auxiliary) top panel 89 is connected along score line 91 to end panel 57, and a second (auxiliary) top panel 92 is connected along score line 93 to end panel 58.

To assemble a container from the blank of FIG. 2, the several panels are folded in a manner similar to that described in respect to FIG. 1, except that the secondary side wall panels 79, 81, 82 and 83 are folded at right angles to the end panels 57 and 58 such that the secondary side wall panels are juxtaposed and secured to the interior surfaces of primary side panels 52 and 53, providing reinforcement of the compressive strength of panels 52 and 53 and the corners of the container. Similarly to the FIG. 1 embodiment, these secondary side wall panels may extend for a combined distance equal to the interior length of the container or, as shown in FIG. 2, for a lesser distance at least sufficient to provide container corner reinforcement.

Auxiliary top panels 89 and 92 are folded inwardly of the container interior and supplement the compressive strength provided by the primary top panels 62 and 63. To close the container, the latter panels then are folded inwardly and the container top is secured by means of the primary and secondary closure tabs as in the FIG. 1 embodiment.

Figure 3:
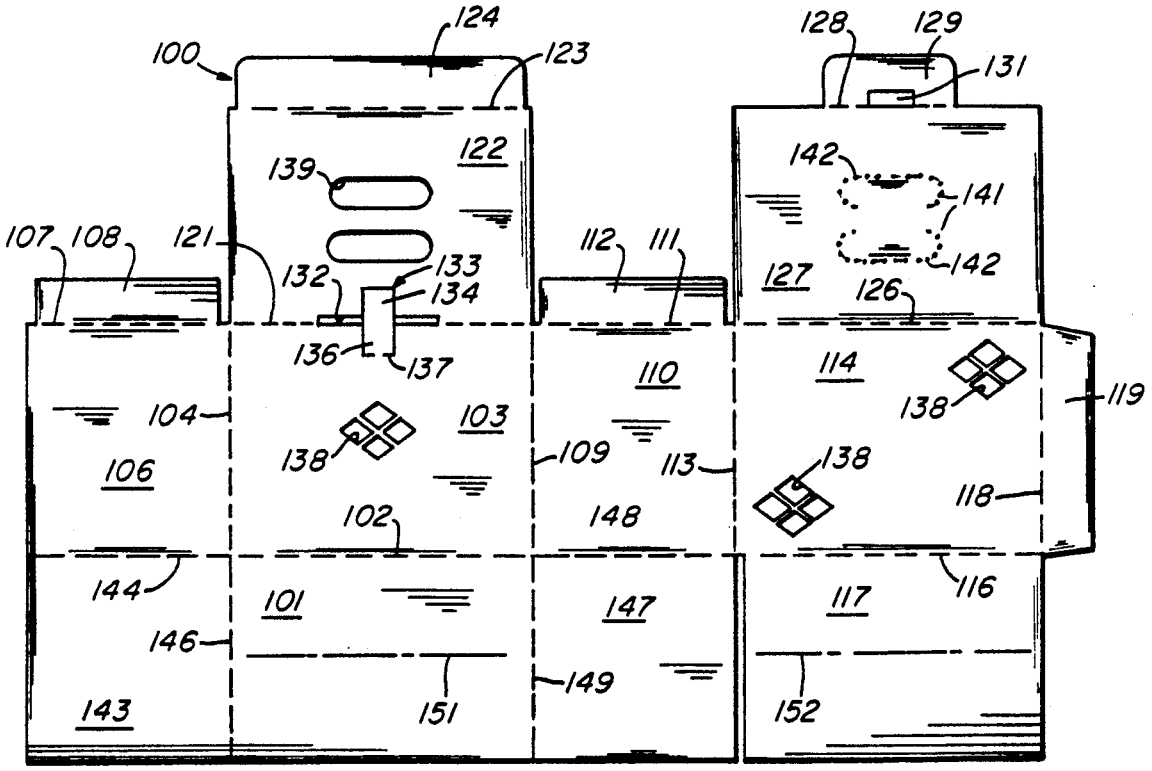
FIG. 3 is a similar view of a still further form of blank from which several different containers in accord with the invention can be assembled.

In FIG. 3, a blank 100 of corrugated paperboard sheet material comprises a first bottom panel 101 is connected along score line 102 to a first side panel 103. Side panel 103 is connected along score line 104 to a first (primary) end panel 106 which is connected along score line 107 to a first (auxiliary) top panel 108 for reinforcing the container top. Side panel 103 also is connected, along score line 109, to a second (primary) end panel 110. End panel 110 is connected along score line 111 to a second (auxiliary) top panel 112 and, by means of score line 113, to a second side panel 114. Side panel 114 is connected along score line 116 to a second bottom panel 117 and, along score line 118, to a container end securing flap 119 extending along the free lateral edge of panel 114.

First side panel 103 also is connected, along score line 121, to a first (primary) top panel 122 which is connected along score line 123 to a container top closure flap 124. Correspondingly, the second side panel 114 is connected, along score line 126, to a second (primary) top panel 127 wherein a score line 128 connects a portion of the outer edge of panel 127 to a primary container top closure tab 129 formed of the sheet material and extending outwardly of the outer edge of side panel 127 and having a secondary container top closure tab slot 131 formed therein in a central portion of the tab 129 adjacent such outer edge of panel 127.

At least one portion of the sheet material of the first (primary) top panel 122 is cut out along score line 121 to form a primary container top closure tab slot 132 adapted to receive the top closure tab 129 in an assembled, closed position of the container. The sheet material of the first side panel 103 and the first (primary) top panel 122, in the area or areas about a central portion of the primary closure tab slot 132, is cut out so as to form a secondary container top closure tab denoted generally by the numeral 133 and comprising an outer portion 134, adapted for receipt in secondary closure tab slot 131 in a closed container position, and an inner portion 136 having its extremity connected to the material of panel 103 along score line 137.

Side panels 103 and 114 are provided with opening patterns 138 for inspection and environmental protection enhancement of the container contents, as described above.

Figure 4:
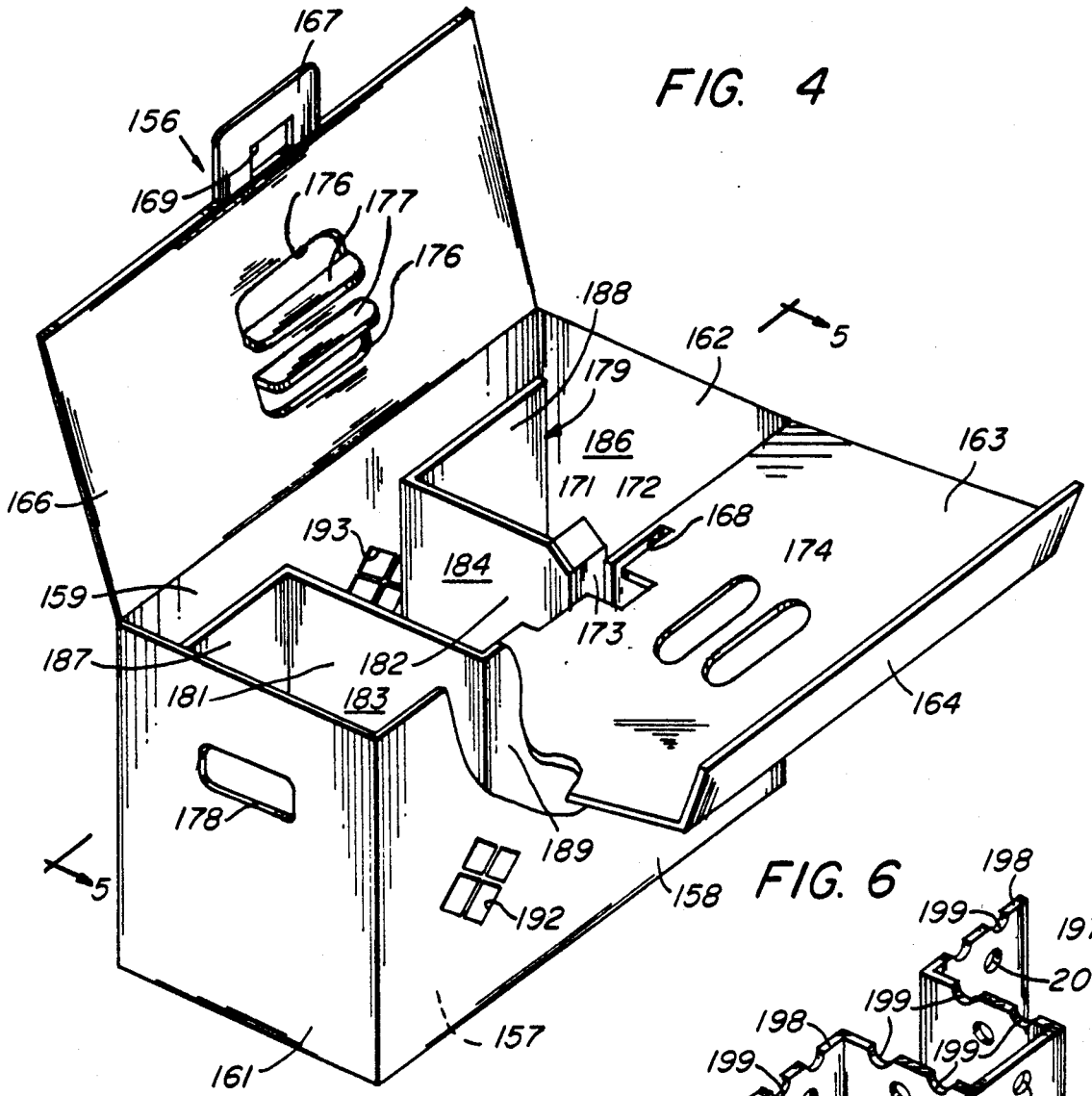
FIG. 4 is a partially cut-away perspective view of one form of container in accordance with the invention, wherein the interior of the container is divided into a plurality of separate compartments by means of a divider insert.

Analogously to the embodiments of the invention shown and described in connection with FIGS. 1 and 2, in the embodiment of FIG. 3, the primary top panel 122 has a pair of elongated, parallel hand carry slots 139 formed therein, and similar slots are formed in primary top panel 127. As in the embodiments of FIGS. 1 and 2, the hand carry slots of the FIG. 3 container are centrally located in top panels 122 and 127. In this embodiment, this feature of the invention is further enhanced by providing at least one pair of hand carry slots, preferably those in the second (primary) top panel, wherein the adjoining, parallel straight portions of the slot peripheries are left intact, with the remaining slot peripheries being perforated, as shown by numerals 141 in FIG. 3, so as to form a pair of push-in flaps as denoted by the numeral 142 in FIG. 3. (Such push-in flaps also are shown in FIG. 4 where they are denoted by the numerals 176 and 177.) The push-in flaps are left in place as an integral part of the panel sheet material until purchase by the consumer thereby providing a completely closed container top preventing entry into the container of contaminating foreign matter during transportation and retail display of the filled container. This preferred closed top container construction makes it necessary that the side wall ventilation opening patterns be arranged as shown and described herein in order to provide the desired flue action for proper air circulation within the otherwise closed container.

In FIG. 3, a first multi-purpose panel 143 is connected along score line 144 to the first (primary) end panel 106 and along score line 146 to the first bottom panel 101. A second multi-purpose panel 147 is connected along score line 148 to the second (primary) end panel 110 and along score line 149 to the first bottom panel 101. Lines 151 and 152 in bottom panels 101 and 117 respectively indicate optional lines of severance of these panels for assembly of alternative container embodiments in accordance with this invention as hereinafter described.

The blank of FIG. 3 can be used to assemble several different container forms. Thus, in a first embodiment (A) of such a container, score lines 144 and 148 are severed, leaving multi-purpose panels 143 and 147 respectively connected to the first bottom panel 101 by means of score lines 146 and 149. These panels, 143 and 147, are folded at right angles along score lines 146 and 149 inwardly and upwardly of the container interior and into juxtaposed relationship with the interior surfaces of the primary end panels 106 and 110 which are folded at right angles to side walls 103 and 114 along score lines 104 and 109. The second bottom panel 117 then is folded along score line 116 to overlie the first bottom panel 101 and forming therewith a self-supporting container bottom. The end wall securing flap 119 is folded along score line 118 inwardly of the container in juxtaposition with and secured to the corresponding portion of the interior surface of the first multi-purpose panel to secure the container side walls together. The multi-purpose panels thereby provide additional container end wall compressive strength. The container top is closed and secured as in the case of the FIG. 1 and FIG. 2 embodiments.

In another embodiment (B) of a container formable from the blank of FIG. 3, the sheet material is severed along score lines 146 and 149, leaving multi-purpose panels 143 and 147 connected along score lines 144 and 148 to the end panels 106 and 110. The second bottom panel 117 is folded, along score line 116, at a right angle to side wall 114 and inwardly of the container. Multi-purpose panels 143 and 147 are folded along score lines 144 and 148 and the thereto connected end panels 106 and 110 are folded, along score lines 104 and 109 inwardly of the container. Closure flap 119 thereby is juxtaposed to an interior surface of end panel 106 and is secured thereto, e.g. by means of a suitable adhesive or tape. The first bottom panel 101 then is folded along score line 102 into juxtaposition with the outer surfaces of the overlying multi-purpose panels and the thus-formed triple-layer container bottom panel is secured by suitable means at the corner formed by the 3-layer container bottom and the second side panel 114. The container is closed and the top is secured in the manner shown and described above.

In an alternate version (B.1) of the last-described embodiment, the multi-purpose panels, connected as last-described, may be folded inwardly and upwardly of the container into juxtaposition with the interior surfaces of the respectively corresponding end panels 106 and 110 and secured thereto, for example by folding the secondary top panels inwardly and downwardly so as to overlie the upper edges of the multi-purpose panels and secured thereto by suitable means.

In yet another example (C) of a container which can be formed from the FIG. 3 blank, the multi-purpose panels are connected as in embodiment (A). The sheet material of the first and second bottom panels 101 and 117 is severed along the respective lengthwise midlines 151 and 152 thereby reducing the width of these panels by one-half. The container is assembled in a manner similar to that of embodiment (A), except for the container bottom wherein the two half-width panels 101 and 117 comprise a single layer bottom which is secured along the abutting edges of the panels 101 and 117 by tape or other suitable means.

In FIG. 4, the numeral 156 illustrates generally a container in accordance with the invention and having at least one bottom panel 157, at least one pair of side wall panels 158 and 159, and at least one pair of end wall panels 161 and 162. The container also comprises at least one pair of top panels 163 and 166. The first top panel 163 has a top closure flap 164 adapted for insertion into the container interior in frictional engagement with the interior surface of side wall 159. The second top panel 166 is provided with a primary top closure tab 167 for insertion into a primary closure tab slot 168 formed in the material of the first top panel 163 and having a secondary top closure tab slot 168 for receipt of an outer end portion 171 of a secondary closure tab 172 connected by an inner end portion 173 to the first side wall panel 158.

First top panel 163 is provided with hand slots 174, and second top panel 166 has similar slots 176 wherein the adjacent parallel portions of the slot peripheries are connected to the sheet material and the remainder of the slot peripheries is perforated so that, when the perforated portions of the sheet material is pushed in, hand carry flaps 177 are formed. As also shown in FIG. 4, supplemental hand carry slots 178 may be formed in each of the container end walls.

The containers of this invention desirably have the interior volume of the container divided into two or more separate compartments for packaging different types of produce or produce items of different grades, varieties or other quality characteristics. For example, two or more varieties, such as a white and a red variety, of a preselected grade of potatoes, e.g. No. 100 grade, are usefully packaged in a single container for consumer purchase and use. For division into two compartments, a single wall corrugated paperboard divider may be inserted into the container midway between the end walls thereof with the end edges of the insert in frictional engagement with the corresponding interior surfaces of the container side walls.

For dividing the container interior into three or more compartments, this invention contemplates provision of a strip of corrugated paperboard sheet material or other environmentally acceptable material having useful stiffness with sufficient flexibility for ready forming into a desired form. An example of such a multi-compartment divider is illustrated in FIG. 4 wherein a divider insert strip denoted generally by the numeral 179 is formed into a generally U-shaped configuration and is inserted into the interior of container 156 with divider side walls 181 and 182 dividing the interior space into three equal compartments 183, 184 and 186. Divider end walls 187 and 188, forming the free end panels of the insert, are positioned in frictional engagement with container side wall 159, and divider end wall 189, forming the closed end panel of the insert 179, is positioned in frictional engagement with container side wall 158.

It is to be understood that any practical number of separate container compartments may be formed by use of such a divider insert strip. For such purpose, an elongated strip of material of appropriate length is formed into a number, N-2, of generally U-shaped units each having a width, W, equal to the desired length of a number, N, of desired container compartments and two flat divider end panels, also of width W. When inserted into the container, the divider insert thereby divides the container interior space into N equal volume compartments.

Figure 5:
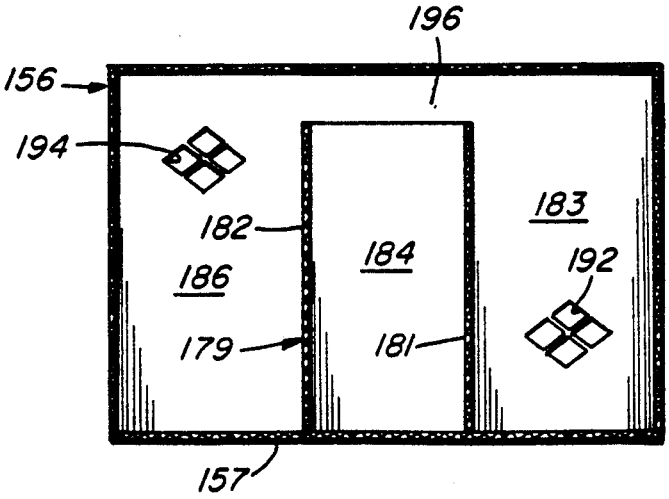
FIG. 5 is a cross-sectional elevation of the container of FIG. 4 taken along line 5—5 thereof.

As previously described, it is desirable to provide for a natural, convective flow of air through the interior of the container, from end-to-end as well as from top-to-bottom. This objective of the invention may be accomplished when using either a single wall divider insert or a multiple wall insert by terminating the top edge of the insert below the mouth of the container. Such construction leaves a space, for example as at 196 in FIG. 5, for flow of air across the divider insert from one container compartment to the other. Thus, in a container as shown in FIGS. 4 and 5, warmer air in compartments 183 and 184 rises inside the container 156 and flows across divider insert walls 181 and 182 and exits the container through the upper-located pattern of openings 194 and cooler outside air is thereby drawn into the container through lower-located opening patterns 192 and 193.

Figure 6:
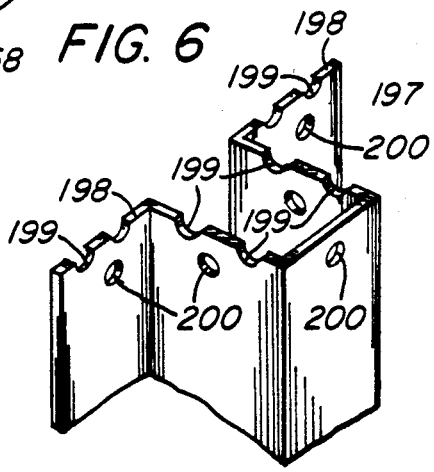
FIG. 6 is a perspective view of a form of insert facilitating a desired air flow pattern within the container.

However, divider inserts, especially the multiple-wall type in accordance with this invention, also can provide enhanced resistance to collapse of stacked containers if the insert extends from the bottom to the top of the container interior. This further function can be realized with such inserts, while also maintaining the desired air flow from end to end of the container, by providing apertures in an upper portion, i.e. at or near the upper edge of the insert walls dividing the container volume into separate compartments. For example, as shown in FIG. 6, an upper edge 198 of an insert 197 may be serrated, for example in the form of a series of notches 199 cut in such insert edge, thereby forming passageways for the flow of air between compartments. Alternatively, apertures, such as openings 200 in FIG. 6, may be provided in an upper portion of the insert side walls.

Therefore, it is preferred either (1) that the top edges of a multi-compartment divider such as that shown in FIG. 4 do not reach completely to the container mouth so as to form compartments completely closed from each other, but, rather, as shown in FIG. 4, that the insert be spaced somewhat below the mouth in order to provide a passageway for air circulation within the container from one compartment to the other, or (2) that the divider insert extend to the container mouth so as to provide the desired container vertical compressive strength reinforcement, and, in which case, that the divider be provided with suitable apertures for air passage. In case (1) above, such a divider structure is more usefully employed in a container embodiment in which reinforcement of the container corners is provided by other means such as the secondary side wall panels shown and described in connection with FIGS. 1–3. The divider construction described in case (2) above, where either a single wall divider or a multiwalled divider extends to the mouth of the container, is more usefully employed where the container is not provided with other side wall and corner reinforcing means.

The container blanks of this invention are conveniently made by die-cutting of the required corrugated sheet material, for example, on a cutter machine programmable to cut the desired configuration from the sheet. Such pre-formed blanks are readily stacked and shipped to a producer for assembly, for example, with the aid of an automatic assembly machine, and filling.

What is claimed is:

1. A container for packaging, transporting and enhancing quality maintenance of fresh produce of a predetermined weight corresponding to a predetermined number of individual produce items of preselected size, the container being assembled from a flat sheet of corrugated paperboard material comprising a bottom panel, a plurality of side panels forming the front, back and end walls of the container and having top edges defining a mouth of the assembled container, the side panels comprising longer primary front and back panels and a pair of shorter primary end panels, each primary side panel having a pair of lateral edges extending along a vertical corner of the assembled container and two pairs of secondary side panels each connected along one edge thereof to a vertically-extending lateral edge of a primary side panel and juxtaposed and secured to the interior surface of an adjoining primary side panel thereby reinforcing the vertical compressive strength of the adjoining primary side panel and a corresponding vertical corner of the container, a first top panel connected along one edge thereof to an upper edge of a first longer side panel and having on an opposed edge thereof a closure flap insertable, in closed position of the first top panel, into the container mouth in frictional engagement with the interior surface of a second longer side panel, a second top panel adapted in closed position of the assembled container to overlie the first top panel and having a primary closure tab insertable in a primary closure slot in the first top panel in a closed position of the second top panel, a secondary closure tab comprising an inner portion formed from the material of the first longer side panel and having one end thereof hingedly connected thereto and the other end thereof hingedly connected to an outer portion formed from the material of the first top panel and, in a closed position of the second top panel, extending above the exterior surface thereof and insertable in a secondary closure slot formed in the primary closure tab, each of the top panels being provided with a pair of parallel, elongated and spaced-apart hand carrying slots located substantially in the inertial center of the container and registrable with such slots in the other top panel in a closed position of the container, at least one of the side walls of the container having opening patterns spaced apart in the depth and length directions of the assembled container and providing means for visual inspection of the container contents and facilitating convective air circulation within the closed container and through such openings resulting from thermal differences inside and outside the container.

2. A container according to claim 1 wherein adjacent parallel edges of the hand slots in at least one of the top panels are hingedly connected to the sheet material of the corresponding panel and the remainder of the periphery of each such slot is perforated whereby the top of the container remains closed until hand carried at which time the perforated sheet material can be pushed inwardly of the container interior thereby forming a pair of hand carry flaps which, in cooperation with the corresponding slots, form a container carrying handle of enhanced resistance to tensile rupture when the container is lifted.

3. A container according to claim 1 wherein the maximum dimensions of the side wall openings is less than the minimum dimensions of the produce items in the container, and the openings in each pattern are arranged to provide a lattice of sheet material between openings in each pattern area such that reduction of container compressive strength below that required for vertical stacking of filled containers is avoided.

4. A container according to claim 3 wherein the side wall openings are of a generally parallelogram shape providing a pattern of similar shape and a generally "X-shaped" side wall-reinforcing lattice of sheet material between the openings in each pattern.

5. A container according to claim 4 wherein the sheet material is double-faced corrugated paperboard having outside and inside facings of weights, respectively, from 33–33 to 42–42 pounds per thousand square feet, a fluted core corrugating medium of at least 26 pounds per thousand square feet weight, and said material having a bursting strength of from about 150 to 200 pounds per square inch.

6. A container according to claim 4 wherein the internal and external length, width and height dimensions of the container are predetermined in accordance with the volume of produce to be packaged therein and the thickness dimension of the sheet material and such that a predetermined number of containers provides a layer fully occupying the area of a standard 40 inch by 48 inch pallet, whereby filled containers are stackable to a height providing a loaded pallet weight of approximately 2000 pounds for shipping in a standard produce truck loading of 40,000 pounds.

7. A container according to claim 6 having a volume capacity sufficient to contain approximately 5 pounds of produce and 20 such containers provide one full pallet layer and the filled containers are stackable 20 high on the pallet thereby providing a full pallet loading of 2000 pounds.

8. A container according to claim 6 having a volume capacity sufficient to contain approximately 10 pounds of produce and 20 such containers provide one full pallet layer and the filled containers are stackable 10 high on the pallet thereby providing a full pallet loading of 2000 pounds.

9. A container according to claim 2 wherein the sheet material has a plurality of foldable score lines defining and adapted for hingedly connecting a plurality of generally rectangular panels forming at least:

a. a bottom panel and a plurality of primary side panels forming the exterior front, back and two end walls of the container each having an inner panel surface facing the container interior and an outer panel surface facing the container exterior, each of said primary side panels having a lower edge hingedly connected to the bottom panel, a pair of lateral edges respectively juxtaposed to the corresponding lateral edges of adjacent side panels in the assembled container, and said side panels having upper edges collectively defining a container mouth, and c. first and second primary top panels each having an unconnected outer edge and an inner edge respectively hingedly connected to the upper edge of a first side panel and an opposed second side panel, said top panels being adapted to overlie each other in a closed position of the container, and wherein:

(1) the first top panel has a flap hingedly connected to the outer edge thereof and adapted for insertion into the container mouth and in frictional engagement with the interior surface of the second side panel adjacent the upper edge thereof, (2) the second top panel has at least one generally rectangular primary closure tab extending outwardly from the outer edge thereof and hingedly connected thereto and having a secondary closure tab slot formed in a mid-portion of each of said tabs adjacent said hinged connection, each of said slots having a width substantially equal to the thickness of the sheet material, and (3) the material of the first top panel along the hinged connection between such panel and the first side panel is provided with at least one primary closure tab slot equal in number to the number of primary closure tabs and the same number of generally rectangular secondary closure tabs is formed in the material of the first top panel and the first side panel along said hinged connection in a central portion of each primary closure tab slot, each secondary closure tab having a width substantially equal to the length of the secondary closure tab slots and registrable therewith in a closed position of the container, whereby, when the second top panel overlies the first top panel in the closed container with the flap on the first top panel inserted into the container mouth in frictional engagement with the interior surface of the second side panel, each primary closure tab is inserted in a corresponding primary closure tab slot and each secondary closure tab is inserted in a corresponding secondary closure tab slot to provide a container top closure wherein, when the container is lifted by means of the carrying handle, resulting tensile force is transmitted through the top panels to the side panels to which they are respectively connected thereby supplementing the resistance to tensile rupture of the frictional closure force of the closure tabs and slots.

10. A container according to claim 9 wherein each of the lateral edges of a pair of opposed primary side panels is hingedly connected along the length thereof to a secondary side panel, each such secondary panel extending outwardly of such hinged connection a maximum distance of one-half the length of an adjacent side panel and juxtaposed to the inner face thereof thereby reinforcing the compressive strength of the corresponding side walls and vertical corners of the container, and each secondary side panel overlapping an opening pattern in a primary side panel having a similar pattern registrable with that in the primary side panel.

11. A container according to claim 10 wherein the secondary side panels are hingedly connected to the primary end panels and are respectively juxtaposed and secured to the inner faces of the corresponding primary front and back panels.

12. A container according to claim 11 wherein the combined linear dimensions of the secondary side panels outwardly of the respective hinged connections to the primary end panels are substantially less than the length of the primary front and back panels, thereby providing full double-layer front and back container walls of enhanced compressive strength.

13. A container according to claim 12 wherein a secondary top panel is hingedly connected to the upper edge of each primary end panel and extends outwardly thereof a distance less than one-half the length of the longer dimension of the bottom panel, thereby supplementing the vertical crushing resistance of the container top and further reinforcing the corners of the container.

14. A container according to claim 10 wherein the secondary side panels are end wall panels hingedly connected to the front and back panels and are respectively juxtaposed to the inner faces of the corresponding primary end panels thereby supplementing the vertical crushing resistance of the container side walls and further reinforcing the corners of the container.

15. A container according to claim 14 wherein the secondary side panels are secured to the primary end panels.

16. A container according to claim 14 wherein a tertiary end panel is hingedly connected to the upper edge of each of the primary end panels, extends outwardly thereof a maximum distance equal to the depth of the container and terminates in an outer edge, and wherein:

a. at least one end wall securing tab extends outwardly of the outer edge of each tertiary end panel a distance slightly greater than the thickness of the sheet material, and b. at least one end wall securing tab slot, equal in number to the number of end wall securing tabs, registrable therewith in the closed container, and having a thickness substantially equal to the thickness of the sheet material, is formed in the bottom panel along the hinged connection between the bottom panel and the primary end panels, whereby a triple-layer container end wall is provided when the secondary end panels are respectively juxtaposed to the interior surface of the primary end panels and the tertiary panels are respectively folded inwardly of the container in a position overlying the corresponding inner faces of the secondary end panels and the end wall securing tabs are respectively inserted into the corresponding end wall securing tab slots, thereby providing enhanced container vertical crushing resistance.

17. A container according to one of claims 14 and 16 wherein the combined length of the dimensions of the secondary side panels outwardly of said hinged connection is substantially less than the length of the primary end panels.

18. A blank for assembly of a hand-carryable container for packaging, transporting and enhancing quality maintenance of fresh produce of a predetermined weight corresponding to a predetermined number of individual produce items of preselected size, said blank having a plurality of generally rectangular panels defined by the edges of the sheet material and a plurality of foldable score lines in the sheet material and comprising at least one bottom panel, at least one pair of relatively longer side panels forming the front and back walls of the assembled container, at least one pair of relatively shorter side panels forming the end walls of the assembled container, a first top panel, a second top panel adapted to overlie the first top panel in the assembled container, each side panel having an upper edge, a lower edge and two opposed lateral edges, each top panel having an inner edge, an outer edge and two opposed lateral edges, the lower edges of the front and back panels being hingedly connected along a foldable score line to the respectively corresponding longer edges of a bottom panel, at least one pair of end panels being similarly hingedly connected at the lower edges thereof to the respectively corresponding shorter edges of a bottom panel, the inner edges of the top panels being similarly hingedly connected to the respectively corresponding upper edges of the front and back panels, means to interconnect the side panels of the blank at the respectively corresponding lateral edges thereof to form a container mouth on assembly of the blank, and wherein:

a. the first top panel is provided with a flap extending along and outwardly from the outer edge thereof and connected thereto by a foldable score line and adapted, when folded at a 90 degree angle with respect to the plane of the first top panel, to be inserted into the interior of the assembled container in juxtaposition to the inside surface of the opposite side panel, b. the second top panel is provided with at least one primary closure tab extending outwardly from the outer edge thereof and connected thereto by a foldable score line and having a secondary closure tab slot formed in a mid-portion of each primary closure tab adjacent the score line between the primary closure tab and the top panel, each secondary closure tab slot having a width substantially equal to the thickness of the sheet material, c. the blank is provided with at least one generally rectangular secondary closure tab equal in number to and registrable with and having a width substantially equal to the length of the closure tab slots in the primary closure tabs, each secondary closure tab having a first tab portion formed by severing the sheet material of the second top panel and having a first tab end which, in the assembled container, extends above the upper surface of the second top panel, and a second tab portion having generally parallel lateral edges formed by severing the sheet material of the side panel to which the first top panel is connected along its inner edge and having a second tab end connected to the side panel from which the tab is formed;

d. at least one primary closure tab slot is formed in the sheet material along the score line between the second top panel and the side panel to which it is connected, the primary closure tab slots being equal in number to and registrable with and having a length substantially equal to the width of the primary closure tabs and extending symmetrically on both sides of the corresponding secondary closure tabs, each primary closure tab slot having a width substantially equal to the thickness of the sheet material, whereby, when the second top panel overlies the first top panel in the assembled container, each primary closure tab slot is adapted to receive a corresponding primary closure tab and each secondary closure tab is adapted to be received in a secondary closure tab slot in a corresponding primary closure tab thereby effecting a frictionally secured closure of the container top;

e. a central portion of the material of each top panel is provided with a pair of parallel, elongated perforations having longer and shorter dimensions defining a pair of spaced-apart push-in flaps at least one pair of which is connected along the respective adjoining longer dimensions thereof with the panel material and adapted, when pushed-inwardly of the interior of the assembled container, to form a container carrying handle, the flap spacing being such that the panel material between the flaps is of sufficient strength to resist rupture upon application of the tensile load of the filled container when carried, and f. at least one side panel is provided with a plurality of openings each of which has a maximum dimension less than the minimum dimension of produce items to be placed in the container, said openings being arranged in at least two patterns providing a lattice of sheet material between openings in each pattern area, the patterns in each side panel being vertically and longitudinally spaced apart to provide convective air circulation inside the container.

19. A blank for assembly of one or another of several different types of fresh produce containers, comprising:

(1) an elongated, generally rectangular sheet of corrugated paperboard provided with three score lines defining and forming hingedly foldable connections between adjacent pairs of four generally rectangular panels consisting of, in sequence, a first end panel, a first side panel, a second end panel, and a second side panel, the side panels having equal length upper and lower edges defining the container length, the end panels having equal length upper and lower edges defining the container width and all such panels having equal length lateral edges defining the container height, the upper and lower edges of the panels forming, respectively, an upper and a lower edge of the sheet and unconnected lateral edges of the end panels defining end edges of the sheet, (2) additional generally rectangular panels of the same sheet material comprising:

(a) first and second top panels each having, in spatial relation to the assembled container, an inner edge and an outer edge of a length substantially equal to the container length and two lateral edges substantially equal to the container width, such top panels being connected along a score line at the inner edges thereof to the upper edge of the sheet along substantially the full length of the corresponding side panels, the first top panel having at least one primary closure tab slot formed therein along the score line connection thereof with the first side panel, each such slot having a width substantially the same as the thickness of the sheet;

(b) a closure flap connected along a score line to the outer edge of the first top panel and extending substantially fully thereacross and outwardly thereof for a distance substantially less than the other dimension of such tab;

(c) at least one primary closure tab connected along a score line to the outer edge of the second top panel and extending thereacross for a distance substantially equal to the length of the primary closure tab slot in the first top panel and outwardly of the second top panel a distance substantially less than the distance between the inner and outer edges thereof and having a secondary closure tab slot formed in a central portion thereof adjacent the score line at the juncture of the primary closure tab and the second top panel and extending thereacross a distance substantially less than the width of the primary closure tab and having a width substantially equal to the thickness of the sheet;

(d) at least one secondary closure tab having a width substantially equal to that of the secondary closure tab slot in the primary closure tab and having a outer unattached portion formed by severing the first top panel material in an area adjacent the mid-portion of each primary closure tab slot and an inner portion formed by severing the sheet material in an area of the first side panel adjacent the midportion of each primary closure tab slot and leaving a inner end of the tab attached to the first side panel;

(e) third and fourth auxiliary top panels respectively hingedly connected along one edge thereof to the top edges of the first and second end panels and extending substantially completely thereacross and outwardly thereof for a distance substantially less than one-half the container length;

(f) a first bottom panel hingedly connected by a score line along one side edge thereof to the lower edge of the first side panel and a second bottom panel having one side edge similarly connected to the lower edge of the second side panel, each bottom panel having an unconnected side edge and two lateral end edges of length equal to the container width, and (g) first and second multiple purpose panels having two lateral edges of length equal to the container width and having inner edges respectively connected along a score line to the lower edges of the first and second end panels, the first multiple purpose panel having an unconnected outer edge, one unconnected lateral edge and the other lateral edge connected along a score line to one lateral edge of the first bottom panel, the second multiple purpose panel having an unconnected outer edge, one unconnected lateral edge and the other lateral edge being connected to the other lateral edge of the first bottom panel, and (3) means to secure together the unconnected lateral edges of the end panels, wherein at least one of the side panels has a plurality of openings having a maximum dimension less than the minimum dimension of produce items to be placed in the container and providing the means for visual inspection of the container contents and for restricted volume and rate of admission of air to the interior of the container and arranged in at least two vertically and longitudinally spaced-apart pattern areas having a lattice of sheet material retained between the pattern openings, whereby reduction of container compressive strength below that required for vertical stacking of assembled containers is avoided, and wherein a central portion of the material of the first and second top panels is provided with perforations forming a pair of parallel elongated hand carry slots wherein the adjacent parallel edges of such slots in at least one top panel are connected with the panel material to provide a pair of flaps adapted, when pushed-inwardly of the interior of the assembled container, thereby forming a container carrying handle, the slot spacing being such that the panel material between the slots is of sufficient strength to resist rupture upon application of the tensile load of the filled container when carried.

20. A container assembled from a blank according to claim 19 wherein:

(1) the sheet material is severed along the score lines between the multiple purpose panels and the corresponding end panels;

(2) the side and end panels are folded at right angles to each other;

(3) the multiple purpose panels are folded, along the score lines connecting them to the first bottom panel upwardly thereof and, with the first bottom panel, are folded inwardly and upwardly of the container interior so that the multiple purpose panels are positioned against the interior surfaces of the end panels and the unconnected edge of the first bottom panel abuts the interior surface of the second side panel;

(4) the second bottom panel is folded, along the score line connecting it to the second side panel, inwardly of the container interior so as to overlie the first bottom panel, and (5) the unconnected lateral edges of the end panels are secured together, the thus-formed container having a self-supported, double-layer bottom and closeable by folding the auxiliary top panels inwardly at right angles to the end panels, folding the first top panel inwardly and downwardly of the container interior thereby positioning the closure flap against the interior surface of the second side panel, folding the second top panel over the first top panel and securing the primary closure tab in the primary closure tab slot and the secondary closure tab in the secondary closure tab

21. A container assembled from the blank of claim 19 wherein:

(1) the multiple purpose panels are severed along the score lines connecting them to the first bottom panel and folded inwardly and upwardly of the container interior into a position against the interior surfaces of the respective end panels;
(2) the first bottom panel is folded inwardly and upwardly of the container interior;
(3) the side and end panels are folded at right angles to each other, the first bottom panel is folded downwardly into the plane of the lower edges of the sheet and the second bottom panel is folded inwardly of the container so as to underlie the first bottom panel, and
(4) the unconnected lateral edges of the end panels are secured together and the second bottom panel is secured to the first bottom panel, and the thus-formed container is closeable by folding the auxiliary top panels inwardly at right angles to the end panels, folding the first top panel inwardly and downwardly of the container interior thereby positioning the closure flap against the interior surface of the second side panel, folding the second top panel over the first top panel and securing the primary closure tab in the primary closure tab slot and the secondary closure tab in the secondary closure tab slot.

22. A container according to claim 20 wherein the first and second bottom panels are severed along a line parallel to and equidistant from the inner and outer edges of the respective such panels and the container panels are folded as in claim 20 wherein the outer edges of the two bottom panels abut each other along the longitudinal centerline of the container bottom and are secured together by suitable means.

23. A container according to claim 1 including an insert comprising at least one divider wall extending from the first side panel to the second side panel thereby dividing the interior of the container into at least two separate compartments of substantially equal volumes, and wherein the opening patterns are arranged so as to provide at least one pattern in a side wall of each compartment and the insert is adapted so as not to obstruct the opening patterns.

24. A container according to claim 23 wherein the insert is an elongated, generally rectangular strip of material formed into a number of generally U-shaped units forming the container compartments.

25. A container according to claim 24 wherein the insert is formed into a number, N-2, of generally U-shaped units each having a width, W, in the longitudinal container direction, equal to the desired length of a number, N, of desired container compartments and two flat end portions of width, W, are positioned against the side panels with the ends of such end portions abutting the interior surfaces of the corresponding end panels of the container, thereby dividing the container interior into N equal volume compartments.

26. A container according to claim 25 wherein the insert strip has a shorter dimension less than the interior depth of the container and at least one pair of the container side walls comprise secondary side panels reinforcing such panels and the container corners against crushing of stacked containers.

27. A container according to claim 25 wherein the insert strip has a shorter dimension substantially equal to the interior depth of the container thereby providing enhanced resistance to compressive crushing of stacked containers, and the insert walls extending between the front and back walls of the container are provided with apertures permitting air circulation between the container compartments.

28. An article according to one of claims 1 and 18 wherein the corrugated paperboard sheet contains a moisture-resistant material in the flutes of the core.

29. A container according to one of claims 1 and 18 wherein the core medium of the corrugated paperboard sheet has a C-flute configuration containing a water resistant material comprising corn starch and caustic soda.

* * * * *